US005450299A

United States Patent [19]

Lepre

[11] Patent Number: 5,450,299

[45] Date of Patent: Sep. 12, 1995

[54] TOUCH ACTIVATED ILLUMINATED HAND RAIL ASSEMBLY

[76] Inventor: Dominic Lepre, 24 Baker Street, Hamilton, Ontario, Canada, L8R 1V3

[21] Appl. No.: 376,796

[22] Filed: Jan. 23, 1995

[51] Int. Cl.[6] ..... F21S 3/02

[52] U.S. Cl. ..... 62/146; 362/222; 362/276; 362/394

[58] Field of Search ..... 362/146, 152, 221, 222, 362/253, 276, 394, 802, 801

[56] References Cited

U.S. PATENT DOCUMENTS

| | | | |
|---|---|---|---|
| 2,310,593 | 2/1943 | Orlicki | 240/2 |
| 2,632,098 | 3/1953 | Marchese | 240/123 |
| 2,766,372 | 10/1956 | Albris | 240/2 |
| 2,810,066 | 10/1957 | Green | 240/123 |
| 3,057,991 | 10/1962 | Grenadier | 240/2 |
| 3,569,689 | 3/1971 | Nestrock | 240/2 |
| 3,740,541 | 6/1973 | Conradt | 240/2 W |
| 3,813,071 | 5/1974 | Noryd | 248/251 |
| 4,161,769 | 7/1979 | Elliott | 362/146 |
| 4,751,625 | 6/1988 | Lin | 362/276 |
| 5,099,402 | 3/1992 | Starniri | 362/146 |

*Primary Examiner*—Stephen F. Husar
*Attorney, Agent, or Firm*—John R. Flanagan

[57] ABSTRACT

A touch activated illuminated hand rail assembly includes a hand rail in the form of an elongated opaque rigid hollow member having a construction of an outer plastic dielectric layer and an inner metallized layer so that the member functions as a capacitor which discharges electrical charge when touched by a person, a light bulb, such as an elongated fluorescent tube, disposed within the hollow member, a pair of conductor wires which connect to an external alternating current power source to provide electricity to the light bulb, an elongated cutout formed in the hollow member through which light emitted by the light bulb may shine outward to illuminate the area where the hand rail is installed, a timer device which turns on the light bulb when electrical charge is discharged from the hollow member and turns off the light bulb after passage of a fixed period of time, and a plurality of mounting brackets which attach the hollow member to a wall or other surface where a person may grasp it for support. As an alternative to an external source of alternating current, batteries disposed within a battery compartment formed in one of a pair of end caps which are removably attached to the end of the hollow member serve as a direct current power source for the light bulb. A low battery power indicator light indicates when it is time to replace the batteries.

21 Claims, 1 Drawing Sheet

TOUCH ACTIVATED ILLUMINATED HAND RAIL ASSEMBLY

BACKGROUND OF THE INVENTION

1. Field of the Invention

The present invention generally relates to electrical lighting fixtures and, more particularly, is concerned with a touch activated illuminated hand rail assembly.

2. Description of the Prior Art

Prior lighting arrangements have recognized the advantage of a combined hand rail and lighting fixture for use in illuminating hallways, flights of stairs and other similar areas. Many such lighting arrangements include an opaque hollow hand rail with a one or more openings or translucent windows. In some, incandescent bulbs within the hollow hand rail emit light which shines through the windows to illuminate a hallway, stairway or other area where the hand rail is installed. Examples of such arrangements are disclosed in U.S. Pat. No. 2,310,593 to Orlicki and U.S. Pat. No. 3,740,541 to Conradt. In others, one or more fluorescent bulbs take the place of incandescent bulbs. Examples of such arrangements are disclosed in U.S. Pat. No. 2,766,372 to Albris and U.S. Pat. No. 4,161,769 to Elliott. Regardless of the type of bulb utilized, each of these prior art arrangements have the advantage of providing both a hand rail which a person can grasp to support themselves and a lighting fixture which illuminates the area where the hand rail is installed. Often, the light is directed primarily downward to illuminate stair steps or the floor.

Unless the combined hand rail and lighting fixture is to remain on permanently, means must be provided to turn the hand rail on and off. Switches mounted on a wall or, as disclosed in U.S. Pat. No. 2,766,372 to Albris, switches located at either end of the rail, have been used to turn prior art illuminated hand rails on and off. Such means of controlling an illuminated hand rail present a disadvantage since a person entering a dark hallway or stairway must first find a relatively small switch in order to illuminate the hallway or stairway. Additionally, such means require a second switch at the opposite end of the hallway or stairway to turn the illuminated hand rail off as the person leaves.

The electrical power necessary to operate an illuminated hand rail is most often supplied by connecting conductor wires extending from the illuminated hand rail directly into the alternating current system of the building in which it is installed. However, at times, such as when an illuminated hand rail is installed long after completion of the design and construction of the building, one powered by a battery has a significant advantage since there is no need to install additional wiring in the building. Prior art illuminated hand rails have utilized suitable batteries instead of alternating current as a power source; however, as with the arrangement disclosed in U.S. Pat. No. 3,740,541 to Conradt, such batteries are not integrated into the construction of the hand rail. Because the batteries are external to the hand rail, they must be placed at a location remote from the hand rail necessitating the installation of external conductor wires running between the batteries and the hand rail. This defeats the purpose of a battery powered illuminated hand rail.

Consequently, a need still exists for a combined hand rail and lighting fixture that overcomes the aforementioned problems with the prior art arrangements.

SUMMARY OF THE INVENTION

The present invention provides a touch activated illuminated hand rail assembly designed to satisfy the aforementioned needs by avoiding the drawbacks of the prior art without introducing other drawbacks. The illuminated hand rail assembly of the present invention includes a touch activated switch for turning on an illuminated hand rail and a timer which turns off the illuminated hand rail after a period of time. Whereas a lamp with a touch activated base is disclosed in U.S. Pat. No. 4,751,625 to Lin, there is no prior art touch activated illuminated hand rail that would allow a person to switch it on simply by grasping the rail thereby eliminating the need to locate a small switch in a dark hallway or stairway. Further, there is no such prior art hand rail that incorporates a timing mechanism which turns the illuminated hand rail off after a period of time so as to eliminate the need for a second switch.

Additionally, the illuminated hand rail assembly of the present invention includes a battery integrated into the design of the illuminated hand rail. A hand rail having a battery incorporated into its construction possesses a significant advantage over a hand rail powered by an external battery since the installation of external conductor wires between the battery and the hand rail would be unnecessary.

The illuminated hand rail assembly of the present invention basically comprises: (a) a rigid opaque hollow hand rail; (b) lighting means, such as a light bulb, within the rail; (c) a pair of conductor wires which may be connected to an alternating current power source to provide electricity to the lighting means; (d) a cutout in the rail through which light emitted from the lighting means may shine outward to illuminate the area where the hand rail is installed; (e) a timer device which turns on the lighting means and turns the lighting means off after a fixed period of time; and (f) a plurality of mounting brackets connected to the hand rail so that the illuminated hand rail may be mounted to a wall or other surface where it can be grasped by a person for support. Although it need not necessarily be, the lighting means is preferably an elongated fluorescent bulb since it would provide a more even distribution of light throughout the length of the hand rail.

One feature of the present invention is that the lighting means is touch activated. The hand rail has an outer or main tubular substrate composed of a plastic dielectric material and an interior metallized layer applied thereto. This construction defines a touch activated switch causing the hand rail to function as a capacitor which discharges electricity when touched by a person. When a person grasps the rail, a small discharge of electricity from the rail cause the timer device to turn on the lighting means.

Another feature of the present invention is that after it is turned on, the lighting means remains on for a fixed period of time and then is turned off by the timer device. Although the hand rail could be designed so that the lighting means is turned off when the rail is touched again, this is not the case with the present invention since doing so would cause the undesired result of turning the lighting means off if a person grabs the rail again as they walk down the stairs or through the hallway. Thus, the present invention has a significant advantage over a touch activated illuminated hand rail that fails to include a timer device which turns the hand rail off only after passage of a fixed period of time.

A further feature of the present invention is an alternative embodiment wherein batteries are disposed within a battery compartment formed in one of a pair of removable end caps which close the open ends of the rail. Instead of connecting the conductor wires to a source of alternating current, the batteries provide electricity to the lighting means. This provides the advantage of allowing the present invention to be installed where it is not feasible to connect the conductor wires to an alternating current power source. An additional feature of this embodiment is a low battery power indicator light which signals when it is time to replace the batteries.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
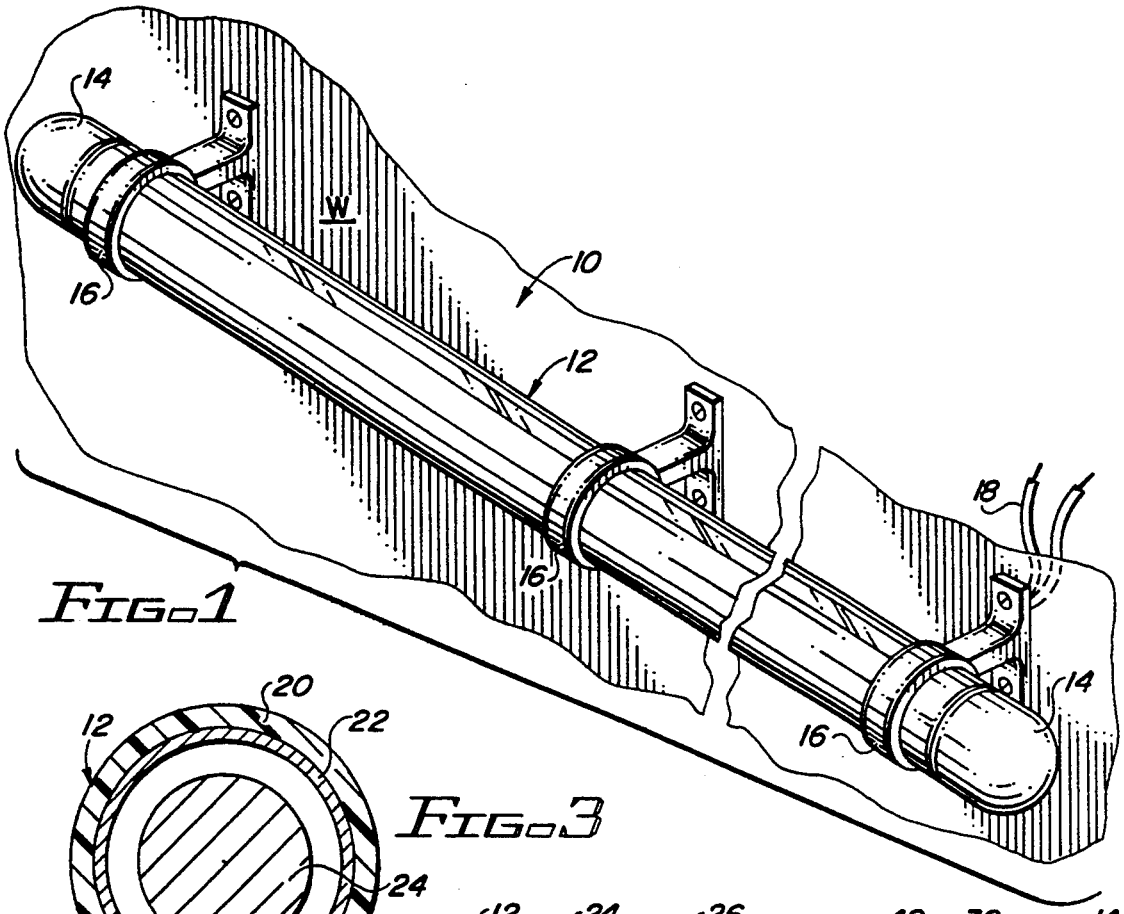
FIG. 1 is perspective view showing a touch activated illuminated hand rail assembly of the present invention mounted to a wall.
Figure 3:
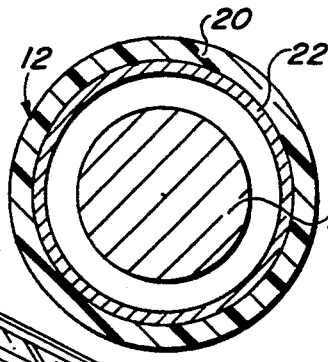
FIG. 3 is a cross-sectional view of the illuminated hand rail assembly taken along line 3—3 in FIG. 2.

Referring to the drawings, and particularly to FIGS. 1 there is illustrated an illuminated hand rail assembly of the present invention, generally designated 10. The illuminated hand rail assembly 10 includes an elongated hand rail 12 including an elongated hollow rigid tube 13 and a pair of end caps 14 disposed at and attached to opposite ends of the tube 13, and a plurality of mounting brackets 16 which attach the hollow tube 13 to a support structure, such as a wall W. A pair of insulated electrical conductor wires 18 connectable to a conventional AC power source run through a passageway in one of the mounting brackets 16.

Referring now to FIGS. 2 through 5, the hollow tube 13 of the hand rail 12 has a construction comprised of an outer or main tubular dielectric substrate 20 made of a suitable dielectric material, such as plastic, and an interior metallized coating or layer 22 applied on the interior of the outer tubular dielectric substrate 20. The interior metallized layer 22 is substantially thinner than the outer tubular dielectric substrate 20. An elongated rectangular cutout 28 is formed through both the substrate 20 and interior layer 22 of the tube 12. A transparent lens 30 is fitted within the cutout 28.

The illuminated hand rail assembly 10 also includes lighting means disposed within the hollow tube 13. The lighting means preferably takes the form of an elongated fluorescent light tube 24 and a ballast 26. The cutout 28 and lens 30 allow light emitted from the fluorescent light tube 24 to be shine outward from within the opaque tube 12. When the tube 12 is attached to the wall W, the cutout 28 and lens 30 may be oriented, such as along the bottom of the hand rail 12, so that light from the fluorescent light tube 24 is directed downward towards the floor or steps.

Figure 6:
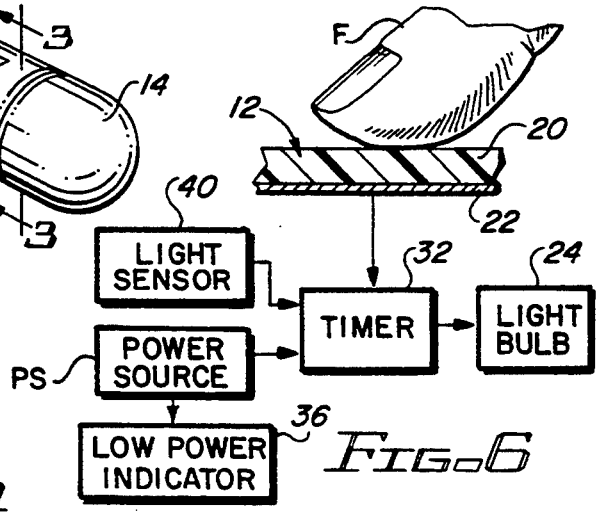
FIG. 6 is schematic diagram of the illuminated hand rail assembly of the present invention.

The illuminated hand rail assembly 10 preferably operates as shown by the schematic diagram illustrated in FIG. 6. When a person's finger F touches the outer tubular substrate 20 of the tube 12, the static charge normally on the person's finger F together with the outer dielectric substrate 20 and interior metallized layer 22 function as a capacitor which discharges electricity in the form of an electrical charge to a timer device 32. The timer device 32 may be disposed within the hollow tube 13 or within one of the end caps 14. When the timer device 32 receives a discharge of electrical charge from the tube 13, it turns on and, in turn, generates a signal which activates the fluorescent light bulb 24 through the ballast 26. The timer device 32 generates the signal due to its connection to a power source PS. After the passage of a preset or fixed period of time, the timer device 32 turns off and, in turn, deactivates the fluorescent light bulb 24 through the ballast 26. The RC constant of the timer device 32 is chosen to preset a desired predetermined time period, such as 3–5 minutes, during which the light bulb 24 will remain on. Typically, the length of the time period would be selected to give a person sufficient time to traverse the length of the hand rail 12.

Figure 5:
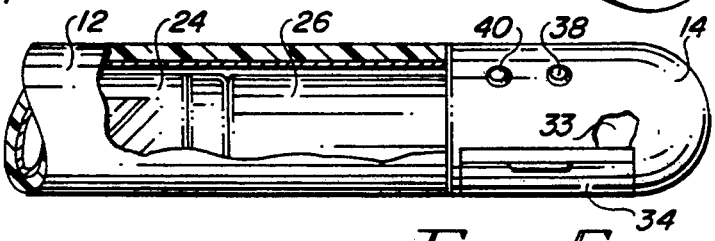
FIG. 5 is a side elevational view of one end of the illuminated hand rail assembly of FIG. 1.
Figure 2:
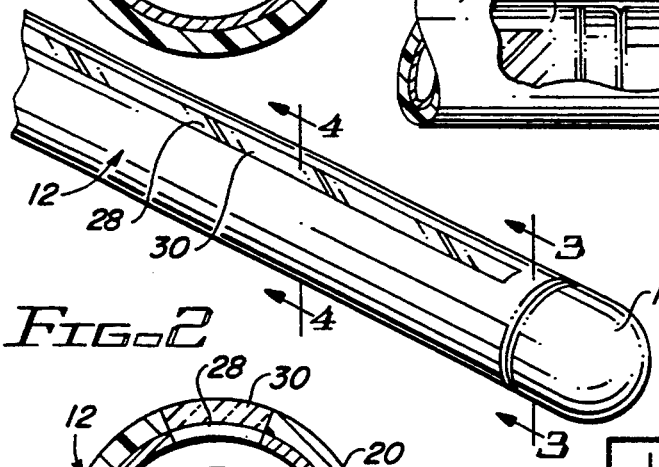
FIG. 2 is a perspective view showing the underside of one end of the illuminated hand rail assembly of FIG. 1.
Figure 4:
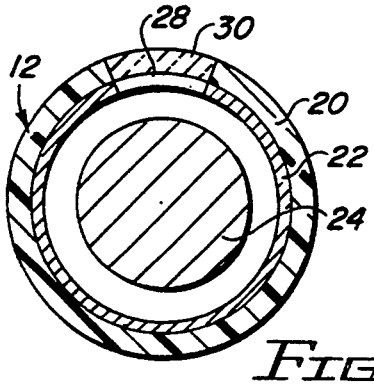
FIG. 4 is another cross-sectional view of the illuminated hand rail assembly taken along line 4—4 in FIG. 2.

In one embodiment of the present invention, a source of alternating current, such as from the public utility lines, which is external to the illuminated hand rail assembly 10 serves as the power source to the ballast 26 for operating the fluorescent light bulb 24. The conductor wires 18 connect the illuminated handrail assembly 10 to this alternating current power source. In another embodiment of the present invention which is shown in FIG. 5, batteries 33 disposed within a battery compartment 34 formed in one of the end caps 14 serves as the power source to the ballast 26. These batteries 33 also can serve as the power source PS for the timer device 32. A low battery power indicator 36 having a well-known operation is provided to indicate via the illumination of a light 38 when it is time to replace the batteries 33.

Also, a light sensor 40, which operates in a well-known manner, is provided to sense a preset amount of light, such as natural light, and in response thereto to inhibit the start of operation of the timer 32. Thus, when there is preset amount of natural light is available, such as during most daylight hours, the use of the touch sensitive light turn-on feature is prevented. However, once the timer 32 has been turned on, the light sensor 40 cannot turn it off. Each of the low battery power indicator 36 and light sensor 40 are constructed of conventional logic circuit components well-known to one of ordinary skill in the art.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A touch activated illuminated hand rail assembly, comprising:

(a) an elongated hand rail including a rigid hollow opaque member having a construction which functions as a capacitor that discharges electrical charge when touched by a person;

(b) lighting means disposed within said hollow member;

(c) a pair of conductor wires connectable to an alternating current power source to provide electrical energy to said lighting means;

(d) an elongated cutout formed in said hollow member through which light emitted from said lighting means may shine outward from said hollow member;

(e) a timer device which operates in response to discharge of electrical charge from said hollow member to switch said lighting means on and then to switch said lighting means off after passage of a fixed period of time; and (f) a plurality of mounting brackets attached to said hollow member so that said hollow member is attachable to a support structure to function as a hand rail which may be grasped by a person for support.

2. The assembly of claim 1 wherein said construction of said hollow member is comprised of an outer plastic dielectric layer and an inner metallized layer.

3. The assembly of claim 1 further comprising:

(g) a transparent lens disposed within said cutout.

4. The assembly of claim 1 wherein said hollow member has the shape of a cylindrical tube.

5. The assembly of claim 1 wherein said lighting means includes an elongated fluorescent tube.

6. The assembly of claim 5 wherein said lighting means also includes a ballast disposed within said hollow member and connected to said fluorescent tube, said conductor wires being connected to said ballast.

7. The assembly of claim 1 wherein said pair of conducting wires extend from said hollow member through a hole in said hollow member and through a passageway in one of said mounting brackets.

8. The assembly of claim 1 wherein said hand rail also includes a pair of end caps disposed at and connected to opposite ends of said hollow member so that openings at each end of said hollow member are closed by said end caps, said end caps being removable so that said lighting means may be removed from said hollow member and a new lighting means installed.

9. The assembly of claim 8 wherein said end caps are dome-shaped.

10. The assembly of claim 8 further comprising:

(g) a plurality of batteries disposed within a hollow battery compartment formed in one of said of end caps or said hollow member, said batteries providing a direct current power source that provides electricity to said lighting means when said conductor wires are not connected to an alternating current power source.

11. The assembly of claim 10 further comprising:

(h) an indicator light which indicates when the power of said batteries is low.

12. A touch activated illuminated hand rail assembly, comprising:

(a) an elongated hand rail including a rigid hollow opaque member having a construction which functions as a capacitor that discharges electrical charge when touched by a person;

(b) a lighting means disposed within said hollow member;

(c) a plurality of batteries disposed within a hollow battery compartment formed in one of a pair of opposite end portions of said hand rail, said batteries providing a direct current power source that provides electricity to said lighting means;

(d) an elongated cutout formed in said hollow member through which light emitted from said lighting means may shine outward from said hollow member;

(e) a timer device which operates in response to discharge of electrical charge from said hollow member to switch said lighting means on and then to switch said lighting means off after passage of a fixed period of time; and (f) a plurality of mounting brackets attached to said hollow member so that said hollow member is attachable to a support structure to function as a hand rail which may be grasped by a person for support.

13. The assembly of claim 12 further comprising:

(g) an indicator light connected to said batteries which indicates when the power of said batteries is low.

14. The assembly of claim 12 wherein said construction of said hollow member is comprised of an outer plastic dielectric layer and an inner metallized layer.

15. The assembly of claim 12 further comprising: (g) a transparent lens disposed within said cutout.

16. The assembly of claim 12 wherein said hollow member has the shape of a cylindrical tube.

17. The assembly of claim 12 wherein said lighting means includes an elongated fluorescent tube.

18. The assembly of claim 17 wherein said lighting means also includes a ballast disposed within said hollow member and connected to said fluorescent tube, said conductor wires being connected to said ballast.

19. The assembly of claim 12 wherein said hand rail also includes a pair of end caps disposed at and connected to opposite ends of said hollow member so that openings at each end of said hollow member are closed by said end caps, said end caps being removable so that said lighting means may be removed from said hollow member and a new lighting means installed.

20. The assembly of claim 19 wherein said end caps are dome-shaped.

21. The assembly of claim 12 further comprising:

(g) a light sensor connected to said timer device for inhibiting the start of operation of said timer device in response to sensing a preset amount of light.

* * * * *